US005176978A

United States Patent [19]

Kumashiro et al.

[11] Patent Number: 5,176,978

[45] Date of Patent: Jan. 5, 1993

[54] TONER FOR ELECTROSTATIC IMAGE AND PROCESS OF PRODUCING THE SAME

[75] Inventors: Kouichi Kumashiro; Tetsu Torigoe; Chiaki Suzuki; Takaichi Kimura; Takayoshi Aoki, all of Kanagawa, Japan

[73] Assignee: Fuji Xerox Co., Ltd., Tokyo, Japan

[21] Appl. No.: 778,378

[22] Filed: Oct. 17, 1991

[30] Foreign Application Priority Data

Dec. 14, 1990 [JP] Japan ..... 2-410512

[51] Int. Cl.[5] ..... G03G 9/097

[52] U.S. Cl. ..... 430/110; 430/137

[58] Field of Search ..... 430/110, 137

[56] References Cited

U.S. PATENT DOCUMENTS

| | | | |
|---|---|---|---|
| 3,925,219 | 12/1975 | Strong | 430/111 X |
| 4,051,077 | 9/1977 | Fisher | 430/110 |
| 4,556,624 | 12/1985 | Gruber et al. | 430/110 |
| 5,085,963 | 2/1992 | Suzuki et al. | 430/110 X |

FOREIGN PATENT DOCUMENTS

| | | | |
|---|---|---|---|
| 89767 | 6/1982 | Japan | 430/137 |
| 109061 | 5/1987 | Japan | 430/110 |
| 196671 | 8/1987 | Japan | 430/110 |
| 8751 | 1/1988 | Japan | 430/137 |
| 101748 | 4/1991 | Japan | 430/137 |

*Primary Examiner*—Roland Martin

*Attorney, Agent, or Firm*—Finnegan, Henderson, Farabow, Garrett and Dunner

[57] ABSTRACT

A dry toner for developing electrostatic images is disclosed, which comprises a binder resin, a colorant and a wax consisting of a low molecular weight polypropylene and a high density polyethylene having a density of 0.96 or more, a molecular weight of 2,000 to 20,000 and an acid value of 1 or less, wherein the wax is dispersed in the binder resin to form domains having a size of 0.1 to 1.5 μm. A process for producing the toner is also disclosed.

6 Claims, No Drawings

TONER FOR ELECTROSTATIC IMAGE AND PROCESS OF PRODUCING THE SAME

FIELD OF THE INVENTION

The present invention relates to a toner for electrostatic images used in electrophotography, electrostatic printing and the like, and a process of producing the toner.

BACKGROUND OF THE INVENTION

In electrophotography, photoconductive materials including selenium are generally used as photoreceptors, and an electric latent image is formed on the photoreceptor by various methods. Then, a toner is adhered to the latent image by magnetic brush developing methods and the like to develop it, and the toner image is transferred to transfer paper, followed by fixing to obtain a copied image.

However, the copied image obtained as described above is sometimes further copied as an original document. In such cases, when the copied image is supplied to an automatic document feeder of a copying machine, the surface of the copied image of the original document is rubbed with a paper feed roll of this device, thereby producing stains and blurs on the image.

In double-sided copying or multi-color copying, first copied image is fixed on a sheet, and then second copying is carried out on the sheet. At this time, the surface of the copied image is rubbed with a paper feed roll, thereby producing stains and blurs on the image. Further, when a plurality of sheets having copied images stored one over the other in a copying machine are taken out one by one with a paper feed roll, the back of one sheet having copied images and the copied image-bearing surface of another sheet are rubbed with each other, thereby producing stains and blurs on both the images, which results in a lowering of image quality.

SUMMARY OF THE INVENTION

It is an object of the present invention to overcome the above-described disadvantage and to provide a toner for developing electrostatic images which is free from occurrence of the stains and blurs due to rubbing on the developed images and a process for producing the toner.

The present invention provides a dry toner for developing electrostatic images, which comprises a binder resin, a colorant and a wax consisting of a low molecular weight polypropylene and a high density polyethylene having a density of 0.96 or more, a molecular weight of 2,000 to 20,000 and an acid value of 1 or less, wherein said wax is dispersed in the binder resin to form domains having a size of 0.1 to 1.5 μm.

The present invention also provides a process of producing a toner for developing electrostatic images, which comprises compounding a binder resin, a colorant and the above-described wax, adding water thereto, melt kneading them, cooling the kneaded product, pulverizing the cooled product and classifying the resulting powder.

DETAILED DESCRIPTION OF THE INVENTION

As the above-described polypropylene which is one component of the wax, it is preferred to use a low molecular weight polypropylene having a molecular weight ranging from 1,000 to 10,000 , more preferably from 2,000 to 10,000, to ensure the release property. Such low molecular weight polypropylenes are commercially available, for example, VISCOL 660P and VISCOL 550P, both produced by Sanyo Chemical Industries, Ltd.

As the above-described polyethylene which is the other component of the wax, a high density polyethylene with a density of 0.96 or more, a molecular weight of 2,000 to 20,000 and an acid value of 1 or less is used to ensure the rubbing-resistant strength. Such high density polyethylenes are also commercially available, and examples includes PE130 and PE190 produced by Hoechst AG; 200P, 400P and 800P producted by MITSUI PETROCHEMICAL INDUSTRIES, LTD.; and ACumist B6 produced by Allied Fibers & Plastics Co.

Thus, the wax is added to ensure the release property and the rubbing-resistant strength of the toner. These properties can be well-balanced when the weight ratio of the polypropylene to the polyethylene is adjusted within the range of from 1/1 to 10/1. The polypropylene has good compatibility with the polyethylene but poor compatibility with other binder resins and it tends to form domains when dispersed in the binder resins, whereas the polyethylene is dispersed in the binder resins in the form of thin layer. If the polypropylene/polyethylene ratio is lower than 1/1, the resulting wax is not apt to form domains in the matrix which results in insufficient release property. If the ratio exceeds 10/1, the rubbing-resistant strength may not be sufficiently exhibited because the property of polypropylene is predominant over that of polyethylene.

The amount of wax, i.e., the total amount of polypropylene and polyethylene, to be compounded is preferably from 2 to 10% by weight, more preferably from 3 to 8 % by weight, based on the total weight of the binder resin and the wax. If the amount of the wax is lower than 2% by weight, it may become difficult to maintain the release property to a heat roll or the rubbing-resistant strength. On the other hand, if the amount exceeds 10% by weight, the storage stability of the toner may be deteriorated.

Examples of the binder resins to be compounded with the wax which also functions as a binder resin include homopolymers and copolymers of styrene compounds such as styrene, chlorostyrene and vinyl styrene; monoolefins such as ethylene, propylene, butylene and isobutylene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. In particular, typical examples of the binder resins include polystyrenes, styrene-alkyl acrylate copolymers, styrene-alkyl methacrylate copolymers, styrene-acrylonitrile copolymers, styrene-butadiene copolymers, styrene-maleic anhydride copolymers, polyethylenes and polypropylenes. They further include polyesters, polyurethane, epoxy resins, silicone resins, polyamides, modified rosin, paraffins and wax. However, the binder resins of the present invention are not limited to the resins described above. Any resins can be used as long as they fit for the object of the present invention.

Further, typical examples of the colorants which can be used in the toners for the electrostatic charge images of the present invention include carbon black, Aniline Blue, Chalcoyl Blue, Chrome Yellow, Ultramarine Blue, Du Pont Oil Red, Quinoline Yellow, Methylene Blue Chloride, Phthalocyanine Blue, Malachite Green Oxalate, lamp black and Rose Bengale. The colorant is generally contained in an amount of 2 to 20% by weight, preferably 4 to 12% by weight, based on the total weight of the binder resin and the wax.

Additives such as charge control agents, cleaning assistants, flowability promoting agents and magnetic materials can be further added as so desired.

The process of the present invention is particularly effective when a quaternary ammonium salt is used as a charge control agent which may be compounded together with the above-described materials.

Typical examples of the quaternary ammonium salt type charge control agents used in the present invention include compounds represented by the following general formulae (I), (II) and (III). However, the scope of the present invention is not limited thereto.

(I)

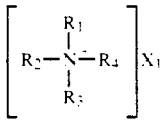

wherein $R_1$, $R_2$, $R_3$ and $R_4$, each represents an alkyl group preferably having 1 to 20 carbon atoms or a benzyl group, and $X_1^-$ represents $Cl^-$,

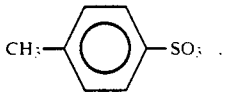

$CH_3SO_4^-$, $(\frac{1}{2})SO_4^{2-}$ or

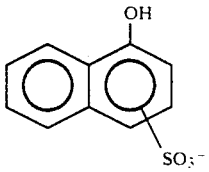

(II)

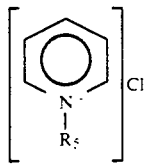

wherein $R_5$ represents an alkyl group preferably having 1 to 20 carbon atoms;

(III)

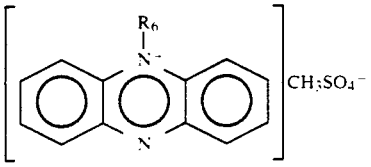

wherein $R_6$ represents an alkyl group preferably having 1 to 20 carbon atoms;

Specific examples of the compounds represented by formula (I) are shown below:

I-1

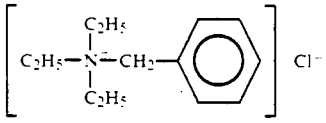

I-2

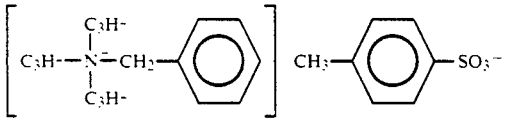

I-3

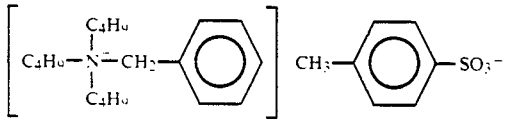

I-4

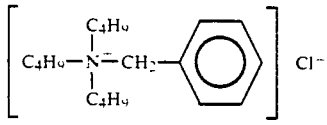

I-5

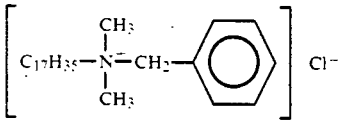

I-6

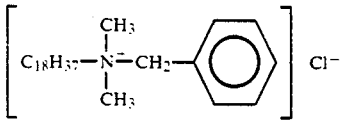

I-7

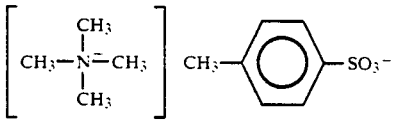

I-8

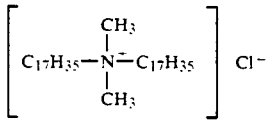

I-9

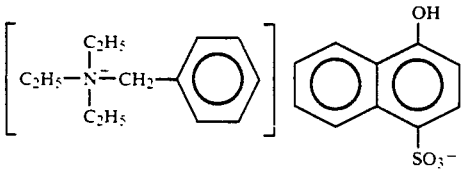

Further, specific examples of the compounds represented by formula (II) are shown below:

II-1

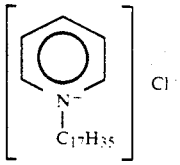

II-2

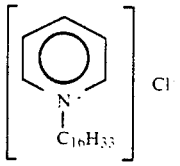

Furthermore, a specific example represented by formula (III) is shown below:

III-1

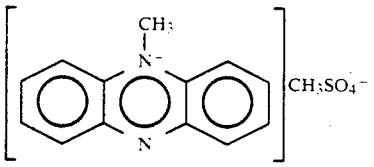

Moreover, examples of compounds other than the compounds represented by the above-described general formulae, which can be used in the present invention, are shown below:

IV-1

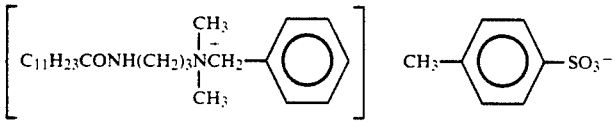

IV-2

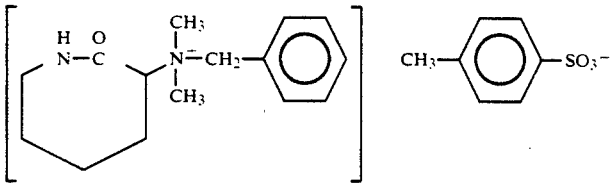

There is no particular limitation on the compounding ratio of the quaternary ammonium salts, but they are preferably added in an amount of 0.1 to 3.0 % by weight based on the total weight of the binder resin and the wax.

The toner materials described above are melt kneaded, and the resulting product is pulverized. Then, the powder thus obtained is classified to produce the toner. The addition of water in melt kneading controls the size of the dispersed wax consisting of the above-described polypropylene and polyethylene, and improves the dispersibility of the water soluble quaternary ammonium salt, whereby the flowability of the toner can be ensured. The amount of water added preferably ranges from 0.5 to 5% by weight, more preferably from 0.5 to 3% by weight, based on the weight of the kneaded product (excluding the weight of water). If the amount of water added is lower than 0.5% by weight, the above-described effect may not be sufficiently exhibited. If the amount exceeds 5% by weight, carbon tends to aggregate to widen the charge distribution of the toner unfavorably.

For the toner thus produced, it is preferred that the dispersed wax domain in the toner has a size ranging from 0.1 to 1.5 μm. The size of the dispersed wax domain can be measured by observing an inner structure of the toner with a transmission electron microscope. If the domain is an ellipsoid, the size is defined by the equation: size=(long axis+short axis)/2, while the domain is generally spherical.

The present inventors variously studied prior art to solve the problems caused by rubbing of the copied images. The addition of a low molecular weight polypropylene to a toner as described in JP-B-52-3304 improved release property, but could not prevent image defects caused by rubbing. (The term "JP-B" as used herein means an "examined Japanese patent publication".) The present inventors discovered low molecular weight polyethylenes exhibiting no release property but excellent rubbing-resistant strength. Namely, the high density polyethylene having a density of 0.96 or more, a molecular weight of 2,000 to 20,000 and an acid value of 1 or less had an excellent rubbing-resistant strength. It was therefore considered that the problems of release property and rubbing resistance could be solved by using the above-described polyethylene in combination with the low molecular weight polypropylene. However, the wax consisting of the above-described polypropylene and polyethylene is essentially poor in dispersibility, so that the compatibility with the binder resin is worsened, which causes the size of the dispersed wax domain to increase.

In particular, when the quaternary ammonium salt having positive charging ability is used, the quaternary ammonium salt is aggregated and dispersed in the interface of the above-described wax domain and the binder resin, so that cracking is liable to occur in this interface upon pulverization. Consequently, the toner having the wax on the surface thereof is significantly deteriorated in flowability. Further, when the above described wax is transferred from the toner to a carrier and adhered thereto with the quaternary ammonium salt contained, another problem is encountered in that the electrification characteristics are deteriorated to extremely lower the reliability of the developer.

Then, the present inventors added water in melt kneading of the toner materials. As a result, the size of the dispersed wax domain of low molecular weight polypropylene and high density polyethylene could be controlled. Further, when the quaternary ammonium salt was compounded as a charge control agent, the quaternary ammonium salt could be uniformly dispersed in the toners since the quaternary ammonium salt is soluble in water.

Thus, the toners could be provided which were improved in their flowability, were stabilized in their electrification characteristics, were free from the problem of the stains on the copied images due to rubbing, and could prevent a high temperature offset. Also, the storage stability of the toners could be improved.

The present invention is hereinafter described in more detail with reference to examples and comparative examples, but it is to be understood that the present invention is not limited thereto. All parts are by weight, unless otherwise specified.

EXAMPLE 1

| | |
|---|---|
| Styrene-Butyl Acrylate Copolymer (80/20) | 100 parts |
| Carbon Black (R-330, manufactured by Cabot Co.) | 10 parts |
| Low Molecular Weight Polypropylene (660P, manufactured by Sanyo Chemical Industries, Ltd.; molecular weight 3,000) | 5 parts |
| High Density Polyethylene (PE130, manufacture by Hoechst AG; density 0.97; molecular weight 9,000; acid value 0) | 1 part |
| Quaternary Ammonium Salt (Bontron P-51, manufactured by Orient Kagaku Co.) | 1 part |

To the above-described components, 1.0% by weight of water was added. Then, the mixture was melt kneaded with a Banbury mixer, cooled and finely pulverized with a jet mill. The resulting powder was classified with a classifier to prepare a toner having an average particle size of 11 μm.

| | |
|---|---|
| Styrene-Methyl Methacrylate Copolymer (80/20) | 100 parts |
| Magnetite (EPT1000, manufactured by Toda Kogyo Corp.) | 200 parts |
| Polyvinylidene Fluoride (KYNAR, manufactured by Penn Walt Co.) | 5 parts |

The above-described components were melt kneaded with a pressure kneader, and further pulverization and classification were carried out using a turbo mill and a classifier, respectively, to obtain a dispersion type carrier having an average particle size of 50 μm. Then, the toner described above was mixed with the resulting carrier at a weight ratio of 5:95 to prepare a two-component developer.

EXAMPLE 2

A two-component developer was produced in the same manner as in Example 1 except that 1 part of 200P (polyethylene manufactured by Mitsui Petrochemical Industries, Ltd.; density 0.97; molecular weight 5,000; acid value 0) was used in place of the polyethylene PE130.

EXAMPLE 3

A two-component developer was produced in the same manner as in Example 1 except that 1 part of ACumist B6 (polyethylene manufactured by Allied Co.; density 0.96; molecular weight 6,000; acid value 0) was used in place of the polyethylene PE130.

EXAMPLE 4

A two-component developer was produced in the same manner as in Example 1 except that the amount of water added in the melt kneading procedure was changed to 0.5% by weight.

EXAMPLE 5

A two-component developer was produced in the same manner as in Example 1 except that the amount of water added in the melt kneading procedure was changed to 5% by weight.

COMPARATIVE EXAMPLE 1

A two-component developer was produced in the same manner as in Example 1 except that the addition of the low molecular weight polypropylene was omitted.

COMPARATIVE EXAMPLE 2

A two-component developer was produced in the same manner as in Example 1 except that the addition of the polyethylene was omitted.

COMPARATIVE EXAMPLE 3

A two-component developer was produced in the same manner as in Example 1 except that 1 part of PE520 (polyethylene manufactured by Hoechst AG; density 0.92; molecular weight 5,000, acid value 0) was used in place of the polyethylene PE130.

COMPARATIVE EXAMPLE 4

A two-component developer was produced in the same manner as in Example 1 except that 1 part of A12 (polyethylene manufactured by Allied Co.; density 0.99; molecular weight; 7,000, acid value 30) was used in place of the polyethylene PE130.

COMPARATIVE EXAMPLE 5

A two-component developer was produced in the same manner as in Example 1 except that 550P (polypropylene manufactured by Sanyo Chemical Industries, Ltd.; molecular weight 5,000) was used in place of the polypropylene 660P and that 1 part of PE190 (polyethylene manufactured by Hoechst AG; density 0.97; molecular weight 40,000; acid value 0) was used in place of the polyethylene PE130.

COMPARATIVE EXAMPLE 6

A two-component developer was produced in the same manner as in Example 1 except that water was not added in the melt kneading procedure.

COMPARATIVE EXAMPLE 7

| | |
|---|---|
| Styrene-Butyl Acrylate Copolymer (80/20) | 100 parts |
| Carbon Black (R-330, manufactured by Cabot Co.) | 10 parts |
| Low Molecular Weight Polypropylene (550P, manufactured by Sanyo Chemical | 2 parts |

-continued

| | |
|---|---|
| Industries, Ltd.) | |
| High Density Polyethylene (PE190, manufacture by Hoechst AG; density 0.97; molecular weight 40,000; acid value 0) | 4 parts |
| Nigrosine (Bontron N-03, manufactured by Orient Kagaku Co.) | 5 parts |

To the above-described components, 1.0% by weight of water was added. Then, the mixture was melt kneaded with a Bumbury mixer, cooled and finely pulverized with a jet mill. The resulting powder was classified with a classifier to prepare a toner having an average particle size of 11 μm.

COMPARATIVE EXAMPLE 8

A two-component developer was produced in the same manner as in Example 1 except that 7.0% by weight of water was added in the melt kneading procedure.

Copying Test

Using the developers produced in Examples 1 to 5 and Comparative Examples 1 to 7, a continuous copying test was performed by an electrophotographic copying machine (FX5075, manufactured by Fuji Xerox Co., Ltd.). The results obtained are shown in Tables 1 and 2.

TABLE 1

| | PP Kind | PE Kind | PE Density | PE Molecular Weight | PE Acid Value | PP/PE | Charge Control Agent | Amount of Water Added | Size of Dispersed Wax Domain |
|---|---|---|---|---|---|---|---|---|---|
| Example 1 | 660P | PE130 | 0.97 | 9000 | 0 | 5 | P-51 | 1.0 | 0.4 |
| Example 2 | 660P | 200P | 0.97 | 5000 | 0 | 5 | P-51 | 1.0 | 0.5 |
| Example 3 | 660P | B6 | 0.96 | 6000 | 0 | 5 | P-51 | 1.0 | 0.5 |
| Example 4 | 660P | PE130 | 0.97 | 9000 | 0 | 5 | P-51 | 0.5 | 1.2 |
| Example 5 | 660P | PE130 | 0.97 | 9000 | 0 | 5 | P-51 | 5.0 | 0.2 |
| Comparative Example 1 | — | PE130 | 0.97 | 9000 | 0 | — | P-51 | 1.0 | 0.3 |
| Comparative Example 2 | 660P | — | — | — | — | — | P-51 | 1.0 | 0.3 |
| Comparative Example 3 | 660P | PE520 | 0.92 | 5000 | 0 | 5 | P-51 | 1.0 | 0.5 |
| Comparative Example 4 | 660P | A12 | 0.99 | 7000 | 30 | 5 | P-51 | 1.0 | 0.5 |
| Comparative Example 5 | 550P | PE190 | 0.97 | 40000 | 0 | 5 | P-51 | 1.0 | 0.7 |
| Comparative Example 6 | 660P | PE130 | 0.97 | 9000 | 0 | 5 | P-51 | 0 | 2.5 |
| Comparative Example 7 | 550P | PE190 | 0.97 | 40000 | 0 | 0.5 | N-03 | 1.0 | 0.7 |
| Comparative Example 8 | 660P | PE130 | 0.97 | 9000 | 0 | 5 | P-51 | 7.0 | 0.2 |

TABLE 2

| | Dispersibility | Carbon Charge Amount | | Stain Due to Rubbing | High Temp. Offset | Shelf Life of Toner |
|---|---|---|---|---|---|---|
| | | Initial | After 100,000 copies | | | |
| Example 1 | G1 | 20 | 15 | No problem | No occurrence | No aggregation |
| Example 2 | G1 | 21 | 14 | No problem | No occurrence | No aggregation |
| Example 3 | G1 | 19 | 17 | No problem | No occurrence | No aggregation |
| Example 4 | G1 | 20 | 12 | No problem | No occurrence | No aggregation |
| Example 5 | G2 | 23 | 20 | No problem | No occurrence | No aggregation |
| Example 6 | | | | No problem | No occurrence | No aggregation |
| Comparative Example 1 | G1 | 20 | 15 | No problem | Occurrence | No aggregation |
| Comparative Example 2 | G1 | 18 | 15 | Occurrence | No occurrence | No aggregation |
| Comparative Example 3 | G1 | 19 | 17 | Occurrence | No occurrence | No aggregation |
| Comparative Example 4 | G1 | 20 | 15 | Occurrence | Occurrence | No aggregation |
| Comparative Example 5 | G2 | 30 | 5 | Occurrence | Occurrence | No aggregation |
| Comparative Example 6 | G1 | 20 | 9 | No problem | No occurrence | Aggregation |
| Comparative Example 7 | G2 | 40 | 5 | Occurrence | Occurrence | No aggregation |
| Comparative Example 8 | G3 | 25 | 12 | No problem | No occurrence | No aggregation |

The molecular weight was measured using a full-automatic high-temperature high-performance chromatography in the following manner: preparing a calibration curve using 12 kinds of TSK standard polystyrenes (an oligomer kit available from TOYO SODA MFG. CO., LTD.) by conducting gel permeation chromatography under the conditions given below; subjecting the tested polyethylene to gel permeation chromatography under the same conditions and determining the molecular weight of the polyethylene from the calibration curve.

Apparatus: ALC/GPC 150C produced by Waters Co.

Data processor: Type 840 HPLC Station produced by Waters Co.

Columns: Shodex AD-80M/S, 2/S and 3/S, produced by Showa Denko K.K.
Solvent: trichlorobenzene
Flow rate: 1.0 ml/min
Temperature: 140° C.
Detector: differential refractometer (RI)
Test sample: concentration about 0.5% processed by heating to 140° C. in the apparatus, spinning, and filtering with a sintered filter having openings of 0.5 μm in diameter
Feed rate: 500 μl The density of the polyethylenes was measured according to JIS K6760, and the acid value thereof was measured according to JIS K5902.

The amount of water added was represented by the percentage by weight of water added per the weight of the raw materials to be kneaded.

The size (μm) of the dispersed wax domain and the dispersibility of carbon were measured by observing an internal structure of the toner enlarged 9,000 times using an H-900 TEM manufactured by Hitachi, Ltd. For the size of the dispersed wax domain, the average size was measured from an enlarged photograph.

The dispersibility of carbon was rated by the dispersed state as follows:
G1: Homogeneous
G2: Substantially homogeneous though a few aggregates exist
G3: Many aggregates exist The charge amount was measured by a blow-off measuring instrument.

The stain due to rubbing was evaluated by visually observing the presence or absence of a stain or a blur on a copied image obtained using the developers of the examples and the comparative example, which was fed with an automatic document feeder FX5075 manufactured by Fuji Xerox to subject to further copying.

The high temperature offset was evaluated by observing the phenomenon that the toner of a copied image was transferred to a high temperature heat roll and then transferred onto the copied image, or the surface or the back of a subsequent copied image.

The shelf life was evaluated by observing whether or not aggregation or coagulation of the toner occurred after 100,000th copying.

According to the present invention, the release property and the rubbing-resistant strength are ensured by using the above-described high density polyethylenes in combination with the low molecular weight polypropylenes, and the above-described polypropylenes and polyethylenes can be homogeneously dispersed even in the presence of the quaternary ammonium salts giving positive charge by adding water in the melt kneading procedure of the toners. Further, the frictional resistance of the surfaces of copied images which have been heat fixed is reduced, whereby damages such as stains due to rubbing and blurs on the copied images resulted from the contact with the paper feed rolls can be significantly reduced.

While the invention has been described in detail and with reference to specific embodiments thereof, it will be apparent to one skilled in the art that various changes and modifications can be made therein without departing from the spirit and scope thereof.

What is claimed is:

1. A dry toner for developing electrostatic images, which comprises a binder resin, a colorant and a wax consisting of a low molecular weight polypropylene having a molecular weight from 1,000 to 10,000 and a high density polyethylene having a density of 0.96 or more, a molecular weight of 2,000 to 20,000 and an acid value of 1 or less, wherein said wax is dispersed in the binder resin to form domains having a size of 0.1 to 1.5 μm, the weight ratio of the polypropylene to the polyethylene in the wax is 1/1 to 10/1, and said wax is present in an amount of 2 to 10% by weight based on the total weight of the binder resin and the wax.

2. The dry toner as claimed in claim 1, further comprising a quaternary ammonium salt as a charge control agent.

3. The dry toner as claimed in claim 2, wherein said quaternary ammonium salt is added in an amount of 0.1 to 3.0% by weight based on the total weight of the binder and the wax.

4. A process of producing a toner for electrostatic images which comprises compounding a binder resin, a colorant, and a wax, adding water thereto, melt kneading them, cooling the kneaded product, pulverizing the cooled product and classifying the resulting powder, in which said was consists of a low molecular weight polypropylene having a molecular weight from 1,000 to 10,000 and a high density polyethylene having a density of 0.96 or more, a molecular weight of 2,000 to 20,000 and an acid value of 1 or less, the weight ratio of the polypropylene to the polyethylene in the was is 1/1 to 10/1, said was is compounded in an amount of 2 to 10% by weight based on the total weight of the binder resin and the wax, and said water is added in an amount of 0.5 to 5% by weight based on the weight of the kneaded product.

5. The process as claimed in claim 4, wherein said quaternary ammonium salt is further compounded as a charge control agent before the melt kneading step.

6. The process as claimed in claim 5, wherein said quaternary ammonium salt is added in an amount of 0.1 to 3.0% by weight based on the total weight of the binder and the wax.

* * * * *

UNITED STATES PATENT AND TRADEMARK OFFICE

CERTIFICATE OF CORRECTION

PATENT NO. : 5,176,978

DATED : January 05, 1993

INVENTOR(S) : Kouichi Kumashiro, et al.

It is certified that error appears in the above-identified patent and that said Letters Patent is hereby corrected as shown below:

Claim 4, Column 12, Line 36 change "was" to --wax--;

Claim 4, Column 12, Line 41 change "was" to --wax--;

Claim 4, Column 12, Line 42 change "was" to --wax--.

Signed and Sealed this

Twenty-eighth Day of December, 1993

*Attest:*

Bruce Lehman

BRUCE LEHMAN

*Attesting Officer*

*Commissioner of Patents and Trademarks*